United States Patent [19]

Gilman

[11] Patent Number: 4,581,823

[45] Date of Patent: Apr. 15, 1986

[54] LETTER OPENER

[76] Inventor: Steve Gilman, P.O. Box 152, Cresco, Pa. 18326

[21] Appl. No.: 694,028

[22] Filed: Jan. 23, 1985

[51] Int. Cl.[4] ..... B26B 3/00; B26B 3/03

[52] U.S. Cl. ..... 30/280; 30/314

[58] Field of Search ..... 30/280, 282, 314, 315, 30/312, 334, 278, 289, 109; D15/127; D8/102

[56] References Cited

U.S. PATENT DOCUMENTS 2,238,753 4/1941 Robie ..... 30/314

2,881,520 4/1959 Kuniomito ..... 30/280

FOREIGN PATENT DOCUMENTS

EP21493 1/1981 European Pat. Off. ..... 30/282

*Primary Examiner*—Paul A. Bell

*Assistant Examiner*—Paul M. Heyrana, Sr.

*Attorney, Agent, or Firm*—Kirschstein, Kirschstein, Ottinger & Israel

[57] ABSTRACT

A letter opener for cutting open an envelope comprises a channel-shaped blade holder having a pair of manually-movable arms and a cutting blade mounted on one of the arms. The blade holder closely embraces opposite sides of a marginal edge region of an envelope to be opened, as well as a longitudinal edge thereof. The cutting blade is operative to pierce through at least one layer of the marginal edge region, and to cut a longitudinally-extending cutting line which is generally parallel to, and offset by a slight spacing from, the longitudinal edge when the holder is guided along the longitudinal edge.

13 Claims, 4 Drawing Figures

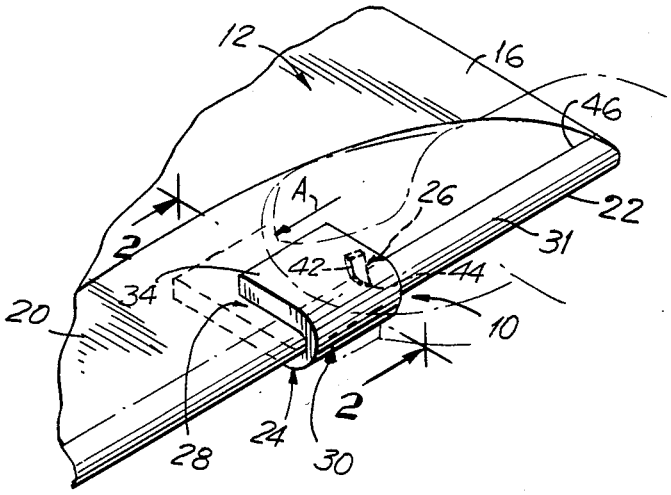
FIG. 1
FIG. 2
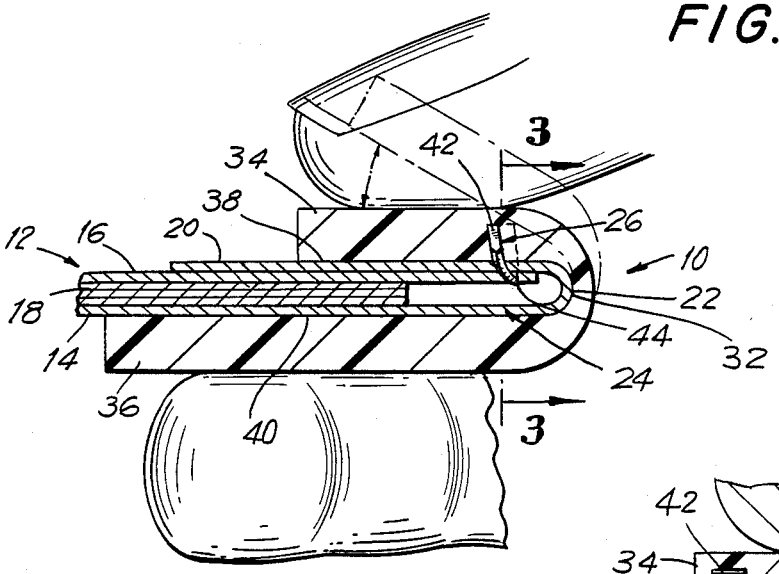
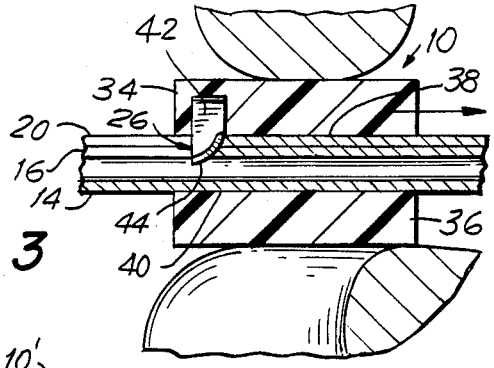
FIG. 3
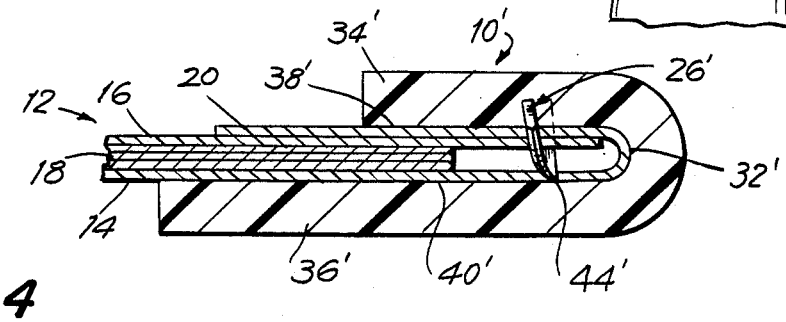
FIG. 4

LETTER OPENER

BACKGROUND OF THE INVENTION

1. Field of the Invention

This invention generally relates to an implement for cutting open an envelope to remove the contents thereof and, more particularly, to a manually operated letter opener.

2. Description of the Prior Art

Letter openers for cutting open envelopes are well known. Typically, a pointed knife-like implement, with or without a serrated cutting edge, is manually inserted underneath an envelope flap, and the implement is then forced in a sawing or smooth motion against a longitudinal edge of the envelope with a sufficient effort to cut or tear through the longitudinal edge, thereby permitting the contents of the envelope to be removed through the cut or torn opening formed therein.

Although generally acceptable for their intended purpose, such knife-like letter openers, despite their widespread use, are not altogether satisfactory. The point of the implement and the presence of a serrated edge represent potential safety hazards. It is sometimes difficult to force the pointed end of the implement underneath the flap, particularly when aggressive adhesives and/or paper tape are used to seal the flaps. In many cases, a smooth cutting open of the envelope along the longitudinal edge is not readily performed, and this results in the envelope being torn apart along an irregular line and, in some cases, completely mutilated.

In an attempt to overcome these prior art drawbacks, the art has also proposed automatic motor-driven letter openers having a clearance slot in which an envelope is inserted and along which the envelope is advanced. A pair of juxtaposed rotary cutting gears are mounted in the slot and are driven to cut off a longitudinal strip of the advancing envelope. Although generally satisfactory for their intended purpose, such automatic letter openers are complex, relatively large, multi-part devices which not only are costly and require a power source, but also, and perhaps more importantly, they leave behind the aforementioned envelope strips as a waste product. These strips accumulate and are very unsightly, particularly when a great deal of mail is being opened at one location.

SUMMARY OF THE INVENTION

1. Objects of the Invention

It is a general object of the present invention to overcome the aforementioned drawbacks of manual and automatic letter openers.

It is another object of the present invention to open an envelope without leaving strips of envelope behind as waste.

It is a further object of the present invention to provide a cutting implement with a sharp cutting edge which, nevertheless, does not represent a potential safety hazard.

It is yet another object of the present invention to open an envelope in a smooth, virtually effortless, continuous, sweeping motion.

It is still another object of the present invention to provide a letter opener which is easy to use, inexpensive to manufacture, durable and reliable in operation.

2. Features of the Invention

In keeping with these objects, and others which will become apparent hereinafter, one feature of the present invention resides, briefly stated, in a letter opener for cutting open an envelope. The letter opener comprises a blade holder and a cutting blade mounted thereon. The blade holder is of a generally U-shaped cross-section, and extends along a longitudinal direction to bound a channel. The holder has an open end through which a marginal edge portion of an envelope to be opened is insertable, and a closed end opposite the open end and having a longitudinally-extending guide surface against which a longitudinal edge of the inserted envelope abuts and along which the longitudinal edge is guided during relative movement between the holder and the envelope in the longitudinal direction. The holder also has a pair of generally plate-shaped contact arms extending between the open and the closed ends. Each arm has a generally planar contact surface extending along the longitudinal direction.

The arms are manually movable between an access position and a cutting position. In the access position, the contact surfaces are spaced apart sufficiently to enable the marginal edge region of the envelope to be freely inserted through the open end and into abutting engagement with the guide surface. In the cutting position, the contact surfaces lie in generally parallel planes, and engage the marginal edge region of the envelope at opposite sides thereof. The engagement of the contact surfaces at opposite sides of the envelope and the concomitant engagement of the guide surface with the longitudinal edge of the envelope are maintained throughout the guided longitudinal movement.

In a preferred embodiment, the closed end extends along a longitudinally-extending fold line, and the arms are pivotable about the fold line. To facilitate the pivoting of the arms about the fold line, the closed end preferably is provided with a reduced thickness zone so as to constitute a living hinge.

The cutting blade is mounted on one of the arms and is spaced at a slight spacing transversely from the guide surface. The blade extends past the contact surface of said one arm into the channel for a predetermined distance sufficient to extend past at least a layer of the marginal edge region of the inserted envelope in the cutting position. The blade has a sharp cutting edge for piercing through the layer and for cutting therein a longitudinally-extending cutting line generally parallel to, and offset by said slight spacing from, the longitudinal edge of the envelope in the cutting position during the guided longitudinal movement of the holder.

Hence, in accordance with this invention, an envelope is cut open in a smooth, virtually effortless, continuous, sweeping motion without the aforementioned drawbacks of the manual and automatic letter openers of the prior art.

In accordance with one embodiment of the invention, the predetermined distance for which the blade extends is sufficient to extend past at least a flap layer and an upper layer of the envelope. In this case, it is only the flap and upper layers of the envelope which are cut open, thereby not leaving any envelope strips behind as waste.

In another embodiment, said predetermined distance for which the blade extends is sufficient to extend not only past the flap layer and the upper layer, but also past the lower layer of the envelope. In this case, the envelope is cut from one side to the other. To eliminate the waste strip caused by this latter embodiment, it is also within the spirit of this invention not to guide the blade holder along the entire length of the longitudinal edge of the envelope, but only for a predominant portion of the longitudinal edge.

The slight spacing at which the blade is located from the guide surface is, in accordance with this invention, on the order of ⅛" therefrom. This spacing is sufficient to ensure that the cutting edge will not likewise pierce any letter or other contents of the envelope during the cutting operation.

Another advantageous feature of this invention is embodied in mounting the generally planar cutting blade at a compound dihedral angle on said one arm so that the cutting edge faces, at least in part, toward the open end of the holder in the cutting position. This feature ensures that the cutting blade will not "run off" the envelope, and that the cutting line will, in fact, be parallel to the longitudinal edge of the envelope throughout the guided longitudinal movement.

The novel features which are considered as characteristic of the invention are set forth in particular in the appended claims. The invention itself, however, both as to its construction and its method of operation, together with additional objects and advantages thereof, will best be understood from the following description of specific embodiments when read in connection with the accompanying drawings.

BRIEF DESCRIPTION OF THE DRAWINGS

FIG. 1 is a broken-away perspective view of one embodiment of a letter opener for cutting open an envelope in accordance with this invention;

FIG. 2 is an enlarged sectional view taken along line 2—2 of FIG. 1;

FIG. 3 is an enlarged sectional view taken along line 3—3 of FIG. 2; and FIG. 4 is a view analogous to FIG. 2 but showing another embodiment of the letter opener in accordance with this invention.

DETAILED DESCRIPTION OF THE PREFERRED EMBODIMENTS

Referring now to the drawings and, more particularly, to FIGS. 1–3, reference numeral 10 generally identifies a letter opener in accordance with a first embodiment of this invention. The letter opener 10 is used for cutting open an envelope 12 to remove the contents therefrom. The illustrated envelope 12 is of a conventional shape and construction and is a rectilinear container, preferably made of paper, in which an object is contained. The most familiar object is, of course, a sheet-like document such as a letter, although it will be readily appreciated that one or more sheets in folded or nonfolded condition may be contained within the envelope. Objects other than letters also can be contained therein.

As shown in FIG. 2, the envelope 12 has a lower paper layer 14 and an upper paper layer 16, which together form a pocket in which a letter 18 is inserted prior to closing the pocket by overlying an adhesive-coated flap layer 20 that is adhered to the upper surface of the upper layer 16 by a non-illustrated adhesive. It will be expressly understood that envelopes other than those made of paper could be opened using the opener of this invention. For example, envelopes made of fiber-reinforced paper, corrugated board, or plastic, or padded, or any other material capable of being cut can similarly be opened. It further will be appreciated that envelopes need not have the illustrated flap layer, but that the flap can extend over the entire surface area of the upper paper layer. Although any one of the four longitudinal regions of the rectilinear envelope may be opened, it is preferable that the longitudinal edge 22 (see FIG. 1) about which the flap layer is folded is the edge region to be opened.

The letter opener 10 comprises a blade holder 24 on which a cutting blade 26 is mounted. The holder 24 is of generally U-shaped cross-section, and extends along a longitudinal direction (see arrow A in FIG. 1) to bound a channel. The holder 24 has an open end 28 through which a marginal edge region 31 of the envelope is insertable, and a closed end 30 opposite the open end. The closed end 30 has a longitudinally-extending guide surface 32 at its inner surface against which the longitudinal edge 22 of the inserted envelope abuts, and along which the longitudinal edge 22 is guided when the holder, as described below, is manually moved relative to the envelope in the longitudinal direction.

The holder 24 has a pair of generally plate-shaped contact arms 34, 36 extending between the open and closed ends. Each arm 34, 36 has a generally planar contact surface 38, 40 which extends along the longitudinal direction.

As best shown in FIG. 2, the arms 34, 36 are manually movable between an access position, shown in phantom lines, in which the contact surfaces 38, 40 lie in intersecting planes and include therebetween a dihedral angle of about 45°, and a cutting position, shown in solid lines. The contact surfaces in the access position are sufficiently far apart to enable the marginal edge region 31 of the envelope to be freely inserted through the open end 28 and into abutting engagement with the guide surface 32. In the access position, the cutting blade 26 does not block or otherwise mechanically interfere with the insertion and placement of the longitudinal edge 22 against the guide surface 32.

By manually pushing the two contact arms 34, 46 toward each other, for example, by finger pressure, the contact arms are moved to the cutting position, shown in solid lines in FIG. 2. In the cutting position, the contact surfaces 38, 40 lie in generally parallel planes, and engage the marginal edge region of the envelope at opposite sides thereof. Specifically, the contact surface 38 of the upper contact arm 34 engages, over a broad surface area, the outer side of the flap layer 20, and the contact surface 40 of the lower contact arm 36 engages, over a similar broad surface area, the outer side of the lower layer 14. The distance between the contact surfaces 38, 40 in the cutting position approximately corresponds to the total thickness of the individual flap, upper, and lower layers, so that the contact surfaces engage the opposite sides of the envelope over virtually their entire surface contact areas. The just-described cutting position is maintained throughout the guided longitudinal movement of the longitudinal edge 22 along the guide surface 32.

The closed end 30 extends along a longitudinally-extending fold line and, in a preferred embodiment, the arms are pivotable about the fold line. To enhance the pivoting movement, the closed end has a reduced thickness zone, as compared to the greater uniform thickness of the contact arms. This reduced thickness zone constitutes a living hinge. Preferably, the holder is formed of molded plastic material.

The guide surface 32, as best shown in FIG. 2, merges into and is continuous with the contact surfaces 38, 40, so that all of the surfaces form in the cutting position a smooth, obstruction-free pocket which frictionally and snugly embraces the marginal edge region at opposite sides thereof, as well as the longitudinal edge of the envelope. This ensures a reliable guiding of the holder in the longitudinal direction.

The cutting blade 26 has a body portion 42 embedded in contact arm 34, and a sharp cutting edge 44 at its opposite end. The cutting blade is generally planar, and is spaced at a slight spacing, on the order of $\frac{1}{8}''$, transversely from the guide surface 32. The blade extends past the contact surface 38 of the arm 34 into the channel for a predetermined distance sufficient to extend past at least the flap layer 20 and the upper layer 16 of the marginal edge region 31 of the inserted envelope in the cutting position. The sharp cutting edge 44 of the blade is operative for piercing through the flap and upper layers, and for cutting therein a longitudinally-extending cutting line 46 (see FIG. 1). The cutting line 46 extends generally parallel to and is offset by the aforementioned slight spacing from the longitudinal edge 22 of the envelope in the cutting position during said guided longitudinal movement.

This slight spacing on the order of $\frac{1}{8}''$ of the cutting blade 26 transversely away from the closed end 30 is sufficient to ensure that the cutting edge will not pierce through the letter 18 which is contained within the envelope. Due to settling and/or folding of the letter 18, it is very rare that the upper edge of the letter extends all the way up to the longitudinal edge 22 of the envelope, and typically is spaced more than $\frac{1}{8}''$ therefrom.

The blade preferably is positioned on the contact arm 34 at a compound dihedral angle relative thereto such that the cutting edge 44 faces, at least in part, toward the open end 28 of the holder in the cutting position. The plane of the cutting blade, as best shown in FIG. 2, is not only inclined, preferably at an acute angle, relative to the plane of the contact surface 38, but also is inclined relative to an imaginary plane that extends normally to the planar contact surface 38.

This skewed orientation of the cutting blade helps to ensure that the holder will not run off the envelope during the longitudinal guided movement, and ensures that the cutting line 46 will be generally parallel to the longitudinal edge 22.

As best shown in FIG. 3, the cutting edge 44 may be arcuate, although it will readily be appreciated that a linear cutting edge, either smooth or serrated, or, for that matter, virtually any cutting edge, likewise could be employed.

In the embodiment of FIG. 4, the holder is essentially identical to that shown for the first embodiment and, hence, like parts have been designated by primed numerals. Thus, the holder 10' has a pair of contact arms 34', 36' manually movable between an access position and a cutting position, as well as a guide surface 32' which engages a longitudinal edge of the envelope. The essential difference lies in the extent to which the blade extends into the channel. Whereas, in the FIG. 2 embodiment, the blade extends through the flap layer 20 and the upper layer 16 to which it is adhered, the blade 26' in FIG. 4 extends all the way through the lower layer 14. In the FIG. 4 embodiment, an envelope strip would be formed as a waste product if the holder 10' were guided along the entire length of the envelope and, hence, to prevent that possibility, the holder is only guided along a predominant portion along the length of the envelope so that the outer end or ends of the marginal edge region 31 are not severed from the surrounding envelope material.

In a typical business letter, the thickness of each of the flap, upper and lower layers can range anywhere from about 2 mils to about 8 mils, the lower end of the range being especially suited for lightweight airmail envelopes, and the higher end of the range being suitable for high quality printed business envelopes. Hence, in the preferred embodiment of FIG. 2, the predetermined distance for which the blade extends into the channel can lie anywhere from about 5 mils to about 18 mils. As for the FIG. 4 embodiment, said predetermined distance lies anywhere within the range of about 8 mils to about 25 mils, depending, of course, upon the thickness of the letter 18.

The operation of the letter opener is believed to be obvious from the description given above. However, to briefly summarize the operation, a user merely inserts an envelope 12 into the holder, when the arms of the latter are in their access position, until the longitudinal edge 22 of the envelope abuts against the guide surface 32 of the holder. Thereupon, the user urges the two contact arms 34, 36 toward each other until their respective contact surfaces 38, 40 engage opposite sides of the marginal edge region 31 to thereby define the cutting position. In the cutting position, of course, the cutting edge 44 of the blade 26 pierces through the juxtaposed flap 20 and upper 16 layers. When the holder is guided along the longitudinal direction, the cutting edge 44 is operative for cutting along the cutting line 46 which is generally parallel to and spaced at about a $\frac{1}{8}''$ transverse spacing from the longitudinal edge 22. Alternatively, the holder can be maintained stationary, and the envelope guided along the longitudinal direction.

In a preferred mode of fabrication, the blade holder, which preferably is made of a moldable synthetic plastic material, is molded with the body portion 42 of the cutting blade 26 embedded therein.

In accordance with another advantageous feature of this invention, the position of the blade holder may be reversed such that the cutting edge 44 pierces through and cuts the lower layer of the envelope. In this case, only a single layer of the envelope, rather than a double layer consisting of the flap and upper layers, need be pierced.

It will be understood that each of the elements described above, or two or more together, may also find a useful application in other types of constructions differing from the types described above.

While the invention has been illustrated and described as embodied in a letter opener, it is not intended to be limited to the details shown, since various modifications and structural changes may be made without departing in any way from the spirit of the present invention. For example, it is not necessary that the two contact arms be pivotable about a longitudinally-extending fold line. The two contact arms may be spaced and maintained apart from each other by a resilient foam rubber spacer which is compressible. The contact arms which are attached on opposite sides of the spacer are movable toward and away from each other between an access position and a cutting position, as described above. Due to the inherent resilience of the spacer, it will automatically return the contact arms to their initial access position.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A letter opener for cutting open an envelope, comprising:

a blade holder of generally U-shaped cross-section and extending along a longitudinal direction to bound a channel, said holder having an open end through which a marginal edge region of an envelope to be opened is insertable, a closed end opposite the open end and having a longitudinally-extending guide surface against which a longitudinal edge of the inserted envelope abuts and along which the longitudinal edge is guided during relative movement between the holder and the envelope in the longitudinal direction, and a pair of generally plate-shaped contact arms extending between the open and the closed ends, each arm having a generally planar contact surface extending along the longitudinal direction, said arms being manually movable between an access position in which the contact surfaces are spaced apart sufficient to enable the marginal edge of the envelope to be freely inserted through the open end and into abutting engagement with the guide surface, and a cutting position in which the contact surfaces lie in generally parallel planes and engage the marginal edge region of the envelope at opposites sides thereof during said guided longitudinal movement of the longitudinal edge of the envelope along the guide surface; and a cutting blade mounted on one of the arms and spaced at a slight spacing transversely from the guide surface, said blade extending past the contact surface of said one arm into the channel for a predetermined distance sufficient to extend past at least a layer of the marginal edge region of the inserted envelope in the cutting position, said blade having a sharp cutting edge for piercing through the layer and for cutting therein a longitudinally-extending cutting line generally parallel to, and offset by said slight spacing from, the longitudinal edge of the envelope in the cutting position during said guided longitudinal movement.

2. The letter opener as recited in claim 1, wherein said closed end extends along a longitudinally-extending fold line, and wherein said arms are pivotable about the fold line.

3. The letter opener as recited in claim 2, wherein the contact arms have a predetermined uniform thickness, and wherein the closed end has a reduced thickness to facilitate the pivoting of the arms about the fold line.

4. The letter opener as recited in claim 1, wherein said slight spacing at which the blade is located is on the order of one-eighth of an inch from the longitudinally-extending guide surface.

5. The letter opener as recited in claim 1, wherein said predetermined distance for which the blade extends is sufficient to extend past at least a flap layer and an upper layer of the envelope.

6. The letter opener as recited in claim 1, wherein said predetermined distance for which the blade extends is sufficient to extend past at least a flap layer, an upper layer and a lower layer of the envelope.

7. The letter opener as recited in claim 5, wherein said predetermined distance lies within a range of five mils to about eighteen mils.

8. The letter opener as recited in claim 6, wherein said predetermined distance lies within a range of eight mils to about twenty-five mils.

9. The letter opener as recited in claim 1, wherein said blade has a body portion embedded in said one arm.

10. The letter opener as recited in claim 1, wherein said cutting edge is arcuate.

11. The letter opener as recited in claim 1, wherein said blade is generally planar and is mounted at a compound dihedral angle on said one arm such that the cutting edge faces, at least in part, toward the open end of the holder in the cutting position.

12. The letter opener as recited in claim 1, wherein said guide surface merges into, and is continuous with, the contact surfaces, all of said surfaces forming in the cutting position a smooth, obstruction-free pocket in which the marginal edge region is securely held at opposite sides of the marginal edge region and along the longitudinal edge.

13. A letter opener for cutting open an envelope, comprising:

a blade holder of generally U-shaped cross-section and extending along a longitudinal direction to bound a channel, said holder having an open end through which a marginal edge region of an envelope to be opened is insertable, a closed end opposite the open end and having a longitudinally-extending guide surface against which a longitudinal edge of the inserted envelope abuts and along which the longitudinal edge is guided during relative movement between the holder and the envelope in the longitudinal direction, and a pair of generally plate-shaped contact arms extending between the open and the closed ends, each arm having a generally planar contact surface extending along the longitudinal direction, said arms being manually movable about a longitudinally-extending fold line between an access position in which the contact surfaces are spaced apart sufficient to enable the marginal edge region of the envelope to be freely inserted through the open end and into abutting engagement with the guide surface, and a cutting position in which the contact surfaces lie in generally parallel planes and engage the marginal edge region of the envelope at opposite sides thereof during said guided longitudinal movement of the longitudinal edge of the envelope along the guide surface; and a generally planar cutting blade fixedly mounted on one of the arms and spaced at a slight spacing on the order of one-eighth of an inch transversely from the guide surface, said blade extending past the contact surface of said one arm into the channel for a predetermined distance sufficient to extend past at least a flap layer and an upper layer of the marginal edge region of the inserted envelope in the cutting position, said blade having a sharp cutting edge for piercing through the layers and for cutting therein a longitudinally-extending cutting line generally parallel to, and offset by said slight spacing from, the longitudinal edge of the envelope in the cutting position during said guided longitudinal movement, said blade being positioned on said one arm at a compound dihedral angle relative thereto such that the cutting edge faces, at least in part, toward the open end of the holder in the cutting position.

* * * * *